US008895490B2

(12) United States Patent
Dole et al.

(10) Patent No.: US 8,895,490 B2
(45) Date of Patent: Nov. 25, 2014

(54) FOOD GRADE COMPRESSOR LUBRICANT

(75) Inventors: Bryan W. Dole, Mount Pleasant, MI (US); Jasween Jagjit, Kawkawlin, MI (US); Michael G. Foster, Midland, MI (US); Kenneth C. Lilje, Midland, MI (US)

(73) Assignee: The Lubrizol Corporation, Wickliffe, OH (US)

( * ) Notice: Subject to any disclaimer, the term of this patent is extended or adjusted under 35 U.S.C. 154(b) by 110 days.

(21) Appl. No.: 13/640,091

(22) PCT Filed: Apr. 6, 2011

(86) PCT No.: PCT/US2011/031331

§ 371 (c)(1), (2), (4) Date: Nov. 28, 2012

(87) PCT Pub. No.: WO2011/130068

PCT Pub. Date: Oct. 20, 2011

(65) Prior Publication Data

US 2013/0065805 A1 Mar. 14, 2013

Related U.S. Application Data

(60) Provisional application No. 61/323,024, filed on Apr. 12, 2010.

(51) Int. Cl.

| | |
|---|---|
| ***C10M 169/04*** | (2006.01) |
| ***C10M 111/04*** | (2006.01) |
| ***C10M 107/00*** | (2006.01) |

(52) U.S. Cl.

CPC ..... *C10M 169/042* (2013.01); *C10N 2240/50* (2013.01); *C10N 2230/10* (2013.01); *C10N 2240/04* (2013.01); *C10N 2250/10* (2013.01); *C10M 2215/223* (2013.01); *C10N 2230/02* (2013.01); *C10N 2220/022* (2013.01); *C10N 2220/021* (2013.01); *C10M 2203/10* (2013.01); *C10M 2215/065* (2013.01); *C10M 2219/085* (2013.01); *C10M 107/00* (2013.01); *C10N 2240/08* (2013.01); *C10M 2205/0285* (2013.01); *C10N 2230/08* (2013.01); *C10N 2230/62* (2013.01); *C10N 2240/30* (2013.01); *C10N 2230/72* (2013.01); *C10M 2203/102* (2013.01); *C10M 2207/2805* (2013.01); *C10M 2207/289* (2013.01); *C10M 2207/126* (2013.01); *C10N 2240/62* (2013.01); *C10M 2215/064* (2013.01); *C10M 169/04* (2013.01); *C10M 2207/2835* (2013.01)

USPC ..... 508/455; 508/452; 508/459; 508/519

(58) Field of Classification Search

CPC ..... C10M 2214/064; C10M 169/04; C10M 2207/2835; C10M 2203/102; C10M 2215/064; C10M 2220/022; A01B 12/006

USPC ..... 508/455, 452, 459, 519

See application file for complete search history.

(56) References Cited

U.S. PATENT DOCUMENTS

| | | | | |
|---|---|---|---|---|
| 4,922,046 | A * | 5/1990 | Kinoshita et al. | 585/11 |
| 6,281,173 | B1 * | 8/2001 | Tanaka et al. | 508/110 |
| 6,534,454 | B1 * | 3/2003 | Garmier et al. | 508/491 |
| 2003/0176301 | A1 * | 9/2003 | Barnes et al. | 508/458 |
| 2004/0241309 | A1 | 12/2004 | Garmier et al. | |
| 2007/0161518 | A1 * | 7/2007 | Walker et al. | 508/155 |
| 2008/0312113 | A1 * | 12/2008 | Beatty et al. | 508/162 |
| 2008/0317964 | A1 * | 12/2008 | Burgo et al. | 427/427.5 |
| 2009/0298731 | A1 * | 12/2009 | Housel et al. | 508/485 |
| 2010/0009875 | A1 | 1/2010 | Dong | |
| 2010/0093571 | A1 | 4/2010 | Paquette et al. | |
| 2010/0105583 | A1 * | 4/2010 | Garmier | 508/155 |
| 2010/0216678 | A1 * | 8/2010 | Patil et al. | 508/497 |

FOREIGN PATENT DOCUMENTS

| | | | |
|---|---|---|---|
| DE | 4229383 | | 3/1994 |
| JP | 2007186698 | A * | 7/2007 |

OTHER PUBLICATIONS

Synfluid (2008).*
Synfluis (2008).*
Spectrasyn (2003).*
National Industrial Chemicals Notification (no date).*
Shubkin, "Polyalphaolefins", CRC Handbook of Lubrication and Tribology: Theory of Tribology, Jan. 1, 1993, pp. 219-236 and 233.
Corresponding International Publication No. WO 2011/0130068 A1 and Search Report published Oct. 20, 2011.

* cited by examiner

*Primary Examiner* — Pamela H Weiss
(74) *Attorney, Agent, or Firm* — Christopher P. Demas, Esq.; David M. Shold, Esq.

(57) ABSTRACT

The invention relates to an improved food-grade-lubricant useful as hydraulic oil, circulating oil, drip oil, general purpose oil, grease base oil, cable oil, chain oil, spindle oil, gear oil, and compressor oil for equipment in the food service industry. Specifically, it relates to a composition comprising at least one polyalphaolefin base fluid, at least one food grade polyolester base fluid, and at least one food grade performance additive.

13 Claims, No Drawings

FOOD GRADE COMPRESSOR LUBRICANT

BACKGROUND OF THE INVENTION

The equipment used in the food processing industry varies by segment with the leading segments comprising meat and poultry, beverages, snack foods, vegetables, and dairy. While the equipment varies from segment to segment, the moving parts such as bearings, gears, and slide mechanisms are similar and often require lubrication. The lubricants most often used include hydraulic, refrigeration, compressor and gear oils, as well as all-purpose greases. These food industry oils must meet more stringent standards than other industry lubricants.

Due to the importance of ensuring and maintaining safeguards and standards of quality for food products, the food industry must comply with the rules and regulations set forth by the United States Department of Agriculture (USDA). The Food Safety inspection Service (FSIS) of the USDA is responsible for all programs involving the inspection, grading, and standardization of meat, poultry, eggs, dairy products, fruits, and vegetables. These programs are mandatory, and inspection of non-food compounds used in federally inspected plants is required.

The FSIS is custodian of the official list of authorized compounds for use in federally inspected plants. The official list (see page 11-1, List of Proprietary Substances and Non-food Compounds, Miscellaneous Publication Number 1419 (1989) by the Food Safety and Inspection Service, United States Department of Agriculture) states that lubricants and other substances that are susceptible to incidental food contact are considered indirect food additives under USDA regulations. Therefore, these lubricants, classified as either H-1 or H-2, are required to be approved by the USDA before being used in food processing plants. The most stringent classification, H-1, is for lubricants approved for incidental food contact. The H-2 classification, is for uses where there is no possibility of food contact, assures that no known poisons or carcinogens are used in the lubricant. One embodiment of the present invention pertains to an H-1 approved lubricating oil. The terms "H-1 approved oil" and "food grade" will be used interchangeably for the purpose of this application.

Although the USDA is no longer approving new ingredients and compositions, the H-1 classification is still recognized by the world food industry. NSF is now listing and approving the food grade classification.

In addition to meeting the requirements for safety set by federal regulatory agencies, the product must be an effective lubricant. Lubricating oils for food processing plants should lubricate machine parts, resist viscosity change, resist oxidation, protect against rusting and corrosion, provide wear protection, prevent foaming and resist the formation of sludge while in service. The product should also perform effectively at various lubrication regimes ranging from hydrodynamic thick film regimes to boundary thin film regimes.

The oxidation, thermal, and hydrolytic stability characteristics of a lubricating oil help predict how effectively an oil will maintain its lubricating properties over time and resist sludge formation. Hydrocarbon oils are partially oxidized when contacted with oxygen at elevated temperatures for prolonged periods of time. The oxidation process produces acidic bodies within the lubricating oil. These acidic bodies are corrosive to metals often present in food processing equipment, and, when in contact with both the oil and the air, are effective oxidation catalysts that further increase the rate of oxidation. Oxidation products contribute to the formation of sludges that can clog valves, plug filters, and result in overall breakdown of the viscosity characteristics of the lubricant. Under some circumstances, sludge formation can result in pluggage, complete loss of oil system flow, and failure or damage to machinery.

The thermal and hydrolytic stability characteristics of lubricating oil reflect primarily on the stability of the lubricating base oil properties and the oil additive package. The stability criteria monitor sludge formation, viscosity change, acidity change, and the corrosion tendencies of the oil. Hydrolytic stability assesses these characteristics in the presence of water. Inferior stability characteristics result in lubricating oil that loses lubricating properties over time and precipitates sludge.

Although such lubricants have been designed to be non-toxic as a food source contaminant, their lubricating properties are often less effective compared to conventional lubricants e.g., lubricants having ingredients not approved for direct food contact. The lubrication industry has, to some degree, overcome this problem by incorporating specialty additives into the lubricant compositions. For example, the inclusion of performance additives has been used to enhance antiwear properties, oxidation inhibition, rust/corrosion inhibition, metal passivation, extreme pressure, friction modification, foam inhibition, and lubricity. Such chemistries are described in the following patents: U.S. Pat. No. 5,538,654 (Lawate, et al.); U.S. Pat. No. 4,062,785 (Nibert); U.S. Pat. No. 4,828,727 (McAninch); U.S. Pat. Nos. 5,338,471 and 5,413,725 (Lai).

A drawback to the food-grade-lubricants described in the above patents relates to oxidation resistance, pour point characteristics, limited formulating capability for viscosity breadth, and limited viscosity protection. The lubricants often have poor rheology characteristics when subjected to prolonged heat and mechanical stress.

Therefore, there remains a need for a food-grade-lubricant that exhibits excellent hydrolytic stability, corrosion resistance, and anti-wear, with substantial improvements in oxidation resistance, pour point, viscosity index, viscosity breadth formulating capability, and viscosity stability when subjected to the thermal and mechanical stresses.

SUMMARY OF THE INVENTION

The invention relates to an improved food-grade-lubricant useful as hydraulic oil, circulating oil, drip oil, general purpose oil, grease base oil, cable oil, chain oil, spindle oil, gear oil, and compressor oil for equipment in the food service industry. Specifically, it relates to a composition comprising at least one polyalphaolefin base fluid, at least one food grade polyolester base fluid, and at least one food grade performance additive.

The invention provides compositions that contain more than 5 percent by weight of a polyolester base fluid. The invention provides compositions wherein component (c) comprises (i) one or more food grade antioxidants and/or (ii) one or more food grade metal passivators, wherein the metal passivators may comprise one or more food grade metal deactivators and/or one or more food grade corrosion inhibitors. The invention also provides compositions that contain more than 5 percent by weight of a polyolester base fluid and wherein component (c) comprises the combination of (i) one or more food grade antioxidants and (ii) one or more food grade metal deactivators and (iii) one or more food grade corrosion inhibitors.

The invention further provides compositions that also contain at least one food grade oil comprising at least one of the following: a synthetic ester, a white petroleum oil, and a severely hydrotreated petroleum oil.

The invention also provides a method for preparing a food-grade-lubricant composition comprising the steps of: a) providing at least one polyalphaolefin base fluid; b) providing at least one polyolester base fluid; c) providing at least one performance additive; and, d) blending the components to form the composition.

The invention also provides a method for lubricating a food industry mechanical device, the method comprising the steps of: lubricating the device with a composition comprising: (a) at least one polyalphaolefin base fluid; (b) at least one polyolester base fluid; and (c) at least one performance additive.

The invention provides improved food-grade-lubricants through the combination of polyalphaolefins and H-1 food-grade polyolesters, particularly when the improved lubricants also contain a combination of one or more food grade antioxidants and one or more food grade metal deactivators. The compositions can provide enhanced oxidation resistance, pour point characteristics, and viscosities and are particularly useful as hydraulic oil, circulating oil, drip oil, general purpose oil, grease base oil, cable oil, chain oil, spindle oil, gear oil, and compressor oil for equipment in the food service industry.

DETAILED DESCRIPTION OF THE INVENTION

Various features and embodiments of the invention will be described below by way of non-limiting illustration.

By "food grade" it is meant a composition or lubricant that meets the criteria set forth by the United States Food and Drug Administration for foods additives and/or lubricants with incidental food contact, for example, as set out in 21 C.F.R. 178.3570 (2007), the contents of which are incorporated herein by reference, and/or which meet the criteria to achieve an "H1" classification from NSF International or an equivalent rating or classification from a counterpart standards setting body.

The Polyalphaolefin Base Fluid

The food-grade-lubricant compositions of the present invention comprise at least one polyalphaolefin. Polyalphaolefins are made by combining two or more alpha olefin molecules into an oligomer, or short-chain-length polymer. PAOs are all-hydrocarbon structures, and they contain no sulfur, phosphorus, or metals. Because they are wax-free, they have low pour points, usually below −40° C. Viscosity grades range from 2 to 100 cSt at 100° C., and viscosity indexes for all but the lowest grades exceed 140. PAOs have good thermal stability, but they require suitable antioxidant additives to resist oxidation. It is common to the industry that PAOs have limited ability to dissolve some additives and tend to shrink seals. It has been found that both problems are overcome by formulating with a polyolester base fluid and also using a food grade antioxidant and/or food grade metal deactivator.

All of the different viscosity grade PAOs mentioned above are included in this invention and are sanctioned by the FDA under 21 CFR 178.3570 USDA H-1, Lubricants with incidental Food Contact (not to exceed 10 ppm extraction into food). Under these sanctions, blending food grade polyolester base fluids into the formula will limit the use of the PAOs, providing an even safer product through dilution. Other useful polyalphaolefins are described in U.S. Pat. No. 6,534,454 incorporated herein by reference.

Examples of suitable PAOs include those at a viscosity at 100° C. of from 1 to 100 cSt. Suitable examples include PAO2, PAO4, PAO6, PAO8, PAO10, PAO40, PAO100, and mixtures thereof. In some embodiments the PAO of the present invention includes PAO4, PAO6, PAO8, PAO9, PAO10, or mixtures thereof. These designations generally refer to PAO with specific viscosities at 100° C., for example PAO2 is a PAO that has a kinematic viscosity of 2 cSt at 100° C.

In some embodiments the PAO used in the compositions of the present invention have a number average molecular weight of about 425 to about 2500.

The polyalphaolefin base fluid is present in the composition in a range of from about 1% to about 90% or from about 30% or 40% to about 70% or 60%. In some embodiments the polyalphaolefin is present in the composition in a range of from 1% to 98.99%, 94.99% or 88.99%. In some embodiments the polyalphaolefin is present in the composition in a range of from 1% to 98.5%, 94.5% or 89.5%

The Polyolester Base Fluid

The food-grade-lubricant compositions of the present invention comprise at least one polyolester base fluid. Polyolesters (POE) are made by combining a polyol with a carboxylic acid. In some embodiments the polyolester base fluid is a reaction product of at least one neopentyl polyhydric alcohol and at least one monocarboxylic acid. The POE base fluid of the present invention must be food grade to be suitable. However, included in this invention is the use of POE base fluids that are currently considered food grade as well as other POE base fluids that have not yet been determined to be food grade, but which might be in the future. In other words, the use of POE base fluids that receive H-1 food grade designation at some point in the future are also contemplated under the current invention.

Properties of these POE base fluids, such as viscosity, viscosity-temperature behavior, oxidation resistance, evaporation loss, hydrolytic stability, and flash point can be modified by selection of the polyol and monocarboxylic acids used to prepare the fluid, and/or by the manufacturing process employed. One of ordinary skill in the art may make such modifications as desired, depending on the end use of the product.

The neopentyl polyhydric polyols suitable for use in preparing the POE base fluids are not overly limited. The neopentyl polyhydric polyols may have any suitable number of hydroxyl groups. It may be preferred that the neopentyl polyhydric polyol has about 2 or 4 to about 12 or 8 hydroxyl groups. Commercially available polyols of this type are, for example, neopentyl glycol, trimethylolpropane, trimethylolethane, pentaerythritol, dipentaerythritol, tripentaerythritol, and tetrapentaerythritol. Preferred polyols may be dipentaerythritol, monopentaerythritol and trimethylolpropane or combinations thereof, although tripentaerythritol and tetrapentaerythritol may be utilized.

The selected neopentyl polyhydric alcohol is reacted with at least one monocarboxylic acid. More than one may be combined; it may be desirable that at least two, three, four, or five monocarboxylic acids are used. Each monocarboxylic acid may have a structure different from the other(s), differing either in type and/or number of chemical constituents that make up the structure or in the arrangement of the constituents relative to one another (e.g., branched chains versus straight chains). The monocarboxylic acid(s) may be straight chain (linear) or branched chain (or any combination of these). It may be preferred that the monocarboxylic acid(s) (branched or straight chain) contain about 2 to about 20 carbon atoms, about 5 to about 12 carbon atoms, or about 5 to about 10 carbon atoms. In some circumstances, shorter chain length linear carboxylic acids may be preferred because thermal stability may decrease as carbon chain length increases.

Examples of linear monocarboxylic acids that may be used include pentanoic acid, decanoic acid, hexanoic acid, heptanoic acid, octanoic acid and nonanoic acid. Branched chain monocarboxylic acids may also be used, either alone or in combination with the linear or straight chained monocarboxylic acids. For example, one may increase the amount of branched chain monocarboxylic acids to modify (raise) the viscosity of the end composition. Branched chain monocarboxylic acids that may be suitable include, without limitation, 2-ethylhexanoic acid and 3,5,5-trimethylhexanoic acid (isononanoic acid).

In an embodiment, the base oil is prepared from the reaction of at least one neopentyl polyhydric alcohol that includes dipentaerythritol and at least one monocarboxylic acid that is pentanoic acid, heptanoic acid, 3,5,5-trimethyl hexanoic acid and/or any combination of these.

In some embodiments the POE base fluid base fluid includes esters of neopentyl glycol, glycerol, trimethylol propane, pentaerythritol, dipentaerythritol, tripentaerythritol, or combinations thereof reacted with carboxylic acids represented by the formula $HOC(O)R^1$, where $R^1$ is a saturated, cyclic, straight chain or branched hydrocarbon radical containing from 4 to 10 carbon atoms.

The POE base fluids used in the compositions of the present invention must be food grade. Commercially available POE base fluids include LEXOLUBE™ FG-68 HX1, FG-100 HX1, FG-220 HX1 and FG-350 HX1, Priolube™ 3970 all available from Inolex™ and Croda™.

The polyolester base fluid is present in the composition in a range of from about 1% to about 90% or from about 30% or 40% to about 70% or 60%. In some embodiments the food-grade polyol ester is present in the composition in a range of from 1%, 5%, 7% or 10% to about 98.99%. In some embodiments the foodgrade polyol ester is present in the composition in a range of from 1%, 5%, 7% or 10% to about 98.5%.

In some embodiments the compositions described herein contain a minimum amount of polyolester base fluid. This minimum amounts may be at least 1%, and in some embodiments at least 5%, 7% or even 10%. In some embodiments the compositions described herein contain a minimum amount of polyalphaolefin base fluid. This minimum amounts may be at least 1%, and in some embodiments at least 5%, 10%, 15% or even 50%.

The Food Grade Performance Additives

The food grade lubricant compositions of the present invention comprise at least one food grade performance additive. Food grade performance additives are additives that have H-1 approval as required by the United States Department of Agriculture and/or are safe for contact with food. It is understood that the H-1 designation will ultimately relate to a comparable classification in countries outside the United States in most cases.

In some embodiments the compositions of the present invention include an antioxidant. In some embodiments the compositions of the present invention include a metal passivator, wherein the metal passivator may include a corrosion inhibitor and/or a metal deactivator. In some embodiments the compositions of the present invention include a corrosion inhibitor. In still other embodiments the compositions of the present invention include a combination of a metal deactivator and a corrosion inhibitor. In still further embodiments the compositions of the present invention include the combination of an antioxidant, a metal deactivator and a corrosion inhibitor. In any of these embodiments the compositions may further include one or more additional performance additives.

The antioxidants suitable for use in the present invention are not overly limited. However in some embodiments the antioxidant must be food grade and must not be used in an amount that would remove the food grade classification from the additive and/or the resulting composition.

Suitable food grade FDA approved antioxidants include butylated hydroxytoluene (BHT), butylatedhydroxyanisole (BHA), phenyl-a-naphthylamine (PANA), octylated/butylated diphenylamine, high molecular weight phenolic antioxidants, hindered bis-phenolic antioxidant, di-alpha-tocopherol, di-tertiary butyl phenol. Other useful antioxidants are described in U.S. Pat. No. 6,534,454 incorporated herein by reference In some embodiments the food grade antioxidant includes one or more of:

(i) Hexamethylenebis(3,5-di-tert-butyl-4-hydroxyhydrocinnamate), CAS registration number 35074-77-2, available commercially from Ciba Specialty Chemical Company;

(ii) N-phenylbenzenamine, reaction products with 2,4,4-trimethylpentene, CAS registration number 68411-46-1, available commercially from Ciba Specialty Chemical Company;

(iii) Phenyl-a-and/or phenyl-b-naphthylamine, for example N-phenyl-ar-(1,1,3,3-tetramethylbutyl)-1-naphthalenamine, available commercially from Ciba Specialty Chemical Company;

(iv) Tetrakis[methylene(3,5-di-tert-butyl-4-hydroxyhydrocinnamate)] methane, CAS registration number 6683-19-8;

(v) Thiodiethylenebis (3,5-di-tert-butyl-4-hydroxyhydrocinnamate), CAS registration number 41484-35-9, which is also listed as thiodiethylenebis (3,5-di-tert-butyl-4-hydroxy-hydro-cinnamate) in 21 C.F.R. §178.3570;

(vi) Butylatedhydroxytoluene (BHT);

(vii) Butylatedhydroxyanisole (BHA), (viii) Bis(4-(1,1,3,3-tetramethylbutyl)phenyl) amine, available commercially from Ciba Specialty Chemical Company; and (ix) Benzenepropanoic acid, 3,5-bis(1,1-dimethylethyl)-4-hydroxy-, thiodi-2,1-ethanediyl ester, available commercially from Ciba Specialty Chemical Company.

The antioxidants may be present in the composition from 0.01% to 6.0% or from 0.02%, 0.03%, 0.05%, 0.1% to 6%, 4%, 2%, 1% or even 0.5%. The additive may be present in the composition at 1%, 0.5%, or less. These various ranges are typically applied to all of the antioxidants present in the overall composition. However in some embodiments these ranges may also be applied to individual antioxidants, so long as the food grade limitations are taken into account.

The metal passivators suitable for use in the present invention are not overly limited and may include both metal deactivators and corrosion inhibitors. However in some embodiments the additives must be food grade and must not be used in an amount that would remove the food grade classification from the additive and/or the resulting composition.

Suitable metal deactivators include triazoles or substituted triazoles. For example, tolyltriazole or tolutriazole may be utilized in the present invention. Suitable examples of food grade metal deactivator include one or more of:

(i) One or more tolu-triazoles, for example N,N-Bis(2-ethylhexyl)-ar-methyl-1H-benzotriazole-1-methanamine, CAS registration number 94270-86-70, sold commercially by Ciba-Geigy under the trade name Irgamet 39;

(ii) One or more fatty acids derived from animal and/or vegetable sources, and/or the hydrogenated forms of such fatty acids, for example Neo-Fat™ which is commercially available from Akzo Novel Chemicals, Ltd.

Suitable food grade corrosion inhibitors include one or more of:

(i) N-Methyl-N-(1-oxo-9-octadecenyl)glycine, CAS registration number 110-25-8;

(ii) Phosphoric acid, mono- and diisooctyl esters, reacted with tert-alkyl and (C12-C14) primary amines, CAS registration number 68187-67-7;

(iii) Dodecanoic Acid;

(iv) Triphenyl phosphorothionate, CAS registration number 597-82-0; and (v) Phosphoric acid, mono- and dihexyl esters, compounds with tetramethylnonylamines and C11-14 alkylamines.

In one embodiment, the metal passivator is comprised of a corrosion additive and a metal deactivator wherein the corrosion inhibitor and the metal deactivator are food grade and comply with FDA regulations. One useful additive is the N-acyl derivative of sarcosine, such as an N-acyl derivative of sarcosine. One example is N-methyl-N-(1-oxo-9-octadecenyl) glycine. This derivative is available from Ciba-Geigy under the trade name SARKOSYL™ O. Another additive is an imidazoline such as Amine O™ commercially available from Ciba-Geigy.

The metal passivators may be present in the composition from 0.01% to 6.0% or from 0.02%, 0.03%, 0.05%, 0.1% to 6%, 4%, 2%, 1% or even 0.5%. The additive may be present in the composition at 0.05% or less. These various ranges are typically applied to all of the metal passivator additives present in the overall composition. However in some embodiments these ranges may also be applied to individual corrosion inhibitors and/or metal deactivators, so long as the food grade limitations are taken into account. The ranges above may also be applied to the combined total of all corrosion inhibitors, metal deactivators and antioxidants present in the overall composition.

The compositions described herein may also include one or more additional performance additives. Suitable additives include antiwear inhibitors, rust/corrosion inhibitors and/or metal deactivators (other than those described above), pour point depressants, viscosity improvers, tackifiers, extreme pressure (EP) additives, friction modifiers, foam inhibitors, emulsifiers, and demulsifiers.

To prevent wear on the metal surface, the present invention utilizes an anti-wear inhibitor/EP additive and friction modifier. Anti-wear inhibitors, EP additives, and friction modifiers are available off the shelf from a variety of vendors and manufacturers. Some of these additives can perform more than one task and any may be utilized in the present invention, as long as they are food grade. One food grade product that can provide anti-wear, EP, reduced friction and corrosion inhibition is phosphorus amine salt such as Irgalube 349, which is commercially available from Ciba-Geigy. Another food grade anti-wear/EP inhibitor/friction modifier is a phosphorus compound such as is triphenyl phosphothionate (TPPT), which is commercially available from Ciba-Geigy under the trade name Irgalube TPPT. The anti-wear inhibitors, EP, and friction modifiers are typically about 0.1% to about 4% of the composition and may be used separately or in combination.

In some embodiments the composition further includes an additive from the group comprising: viscosity modifiers-including, but not limited to, ethylene vinyl acetate, polybutenes, polyisobutylenes, polymethacrylates, olefin copolymers, esters of styrene maleic anhydride copolymers, hydrogenated styrene-diene copolymers, hydrogenated radial polyisoprene, alkylated polystyrene, fumed silicas, and complex esters; and food grade tackifiers like natural rubber solubilized in food grade oils.

The addition of a food grade viscosity modifier, thickener, and/or tackifier provides adhesiveness and improves the viscosity and viscosity index of the lubricant. Some applications and environmental conditions may require an additional tacky surface film that protects equipment from corrosion and wear. In this embodiment, the viscosity modifier, thickener/tackifier is about 1 to about 20 weight percent of the lubricant. However, the viscosity modifier, thickener/tackifier can be from about 0.5 to about 30 weight percent. An example of a food grade material that can be used in this invention is Functional V-584 a Natural Rubber viscosity modifier/tackifier, which is available from Functional Products, Inc., Macedonia, Ohio. Another example is a complex ester CG 5000 that is also a multifunctional product, viscosity modifier, pour point depressant, and friction modifier from Inolex Chemical Co, Philadelphia, Pa.

Other food grade oils and/or components may be also added to the composition in the range of about 0.1 to about 30%. These food grade oils could include white petroleum oils, synthetic esters (as described in patent U.S. Pat. No. 6,534,454), severely hydro-treated petroleum oil (known in the industry as "Group II or III petroleum oils").

Industrial Application

In some embodiments each of the composition ingredients of the composition described herein have H-1 approval as required by the United States Department of Agriculture. It is understood that the H-1 designation will ultimately relate to a comparable classification in countries outside the United States in most cases.

The compositions described herein may be prepared by blending the various components together. The means of blending and/or order of addition is not overly limited.

Although the composition of the present invention is particularly useful as a lubricant in the food service industry, it is not limited to applications that require direct food contact. For example, the unique combination of properties allows the inventive lubricant to be used in any application wherein a continuous and efficient reduction in friction is required. Examples may include engine oil, hydraulic fluid, grease, etc.

The food-grade-lubricant compositions described above can be used in all types of food processing equipment.

In some embodiments the compositions of the present invention are: (i) from 5 or 10 to 40 or 25% food grade polyol ester base fluid, (ii) from 70 or 72 to 87 or 90% polyalphaolefin base fluid, (iii) from 0.05, 0.5, 1.0 or 2.0 to 2.5% antioxidants, (iv) from 0.01, or 0.05 to 0.1 or 0.07 metal deactivators and/or corrosion inhibitors, or (v) any combination thereof.

EXAMPLES

The invention will be further illustrated by the following examples, which sets forth particularly advantageous embodiments. While the examples are provided to illustrate the present invention, they are not intended to limit it. Unless otherwise noted, each of the additives and additive packages described below may contain some amount of diluent oil or similar material.

Example 1

A food grade lubricant is prepared by blending a polyalphaolefin base fluid, PAO-6 with an antioxidant additive package and a metal passivator package. The additive package contains (i) N-phenyl-ar-(1,1,3,3-tetramethylbutyl)-1-naphthalenamine, (ii) N-phenylbenzenamine reaction products with 2,4,4-trimethylpentene, and (iii) 1,6-hexamethylenebis(3,5-di-tert-butyl-4-hydroxyhydrocinnamate), where the antioxidants are present in the package at weight ratios of 2.5:2.5:1 respectively. The metal passivator package contains Neo-Fat™, a fatty acid corrosion inhibitor, and Irgamet™ 39, a benzotriazole metal deactivator, in a weight ratio of 2.5:1 respectively.

The resulting blend contains 0% food grade polyolester, 98.7% polyalphaolefin, 2.2% of the antioxidant additive package, and 0.07% of the metal passivator package. The resulting blend has a kinematic viscosity at 40° C. of 32 cSt.

Example 2

A food grade lubricant is prepared by blending a food grade polyolester base fluid and a blend of two polyalphaolefin base fluids, PAO-8 and PAO-6 where the weight ratio of the polyalphaolefin base fluids in the blend is 1.2:1 respectively. An antioxidant additive package is added to the blend. The antioxidant package contains equal parts on a weight basis of (i) N-phenyl-ar-(1,1,3,3-tetramethylbutyl)-1-naphthalenamine, (ii) bis(4-(1,1,3,3-tetramethylbutyl)phenyl) amine, (iii) N-phenylbenzenamine reaction products with 2,4,4-trimethylpentene, (iv) 1,6-hexamethylenebis(3,5-di-tert-butyl-4-hydroxyhydrocinnamate), and (v) benzene-propanoic acid, 3,5-bis(1,1-dimethylethyl)-4-hydroxy-, thiodi-2,1-ethanediyl ester.

The resulting blend contains 10% food grade polyolester, 87.5% of the polyalphaolefin blend and 2.5% of the antioxidant additive package (such that each antioxidant is present at 0.50%). The resulting blend has a kinematic viscosity at 40° C. of 39 cSt.

Example 3

A food grade lubricant is prepared by blending a food grade polyolester base fluid and a blend of two polyalphaolefin base fluids, PAO-8 and PAO-6 where the weight ratio of the polyalphaolefin base fluids in the blend is 3.31 respectively. The antioxidant additive package described in Comparative Example 2 is added to the blend. A metal passivator additive package is also added to the blend. The metal passivator package contains Neo-Fat™, a fatty acid corrosion inhibitor, and Irgamet™ 39, a benzotriazole metal deactivator, in a weight ratio of 2.5:1 respectively.

The resulting blend contains 25% food grade polyolester, 72.43% of the polyalphaolefin blend, 2.5% of the antioxidant additive package (such that each antioxidant is present at 0.50%) and 0.07% of the metal activator additive package. The resulting blend has a kinematic viscosity at 40° C. of 46 cSt.

Example 4

A food grade lubricant is prepared following the procedures of Example 3. The resulting blend contains 25% food grade polyolester, 72.43% of the polyalphaolefin blend, 2,5% of the antioxidant additive package (such that each antioxidant is present at 0.50%) and 0.07% of the metal activator additive package. The resulting blend has a kinematic viscosity at 40° C. of 39 cSt.

Each of the examples is tested in a hot room compressor test. The involves supply each test lubricant to a variable speed drive rotary screw compressor operating at 110° C. (230° F.) and 100 psia. Samples of the lubricant are taken every 160 hours of compressor operation time and analyzed to evaluate the performance of the lubricant. Each sample is analyzed to determine the total acid number (TAN) of the lubricant, as measured by ASTM D974. A higher TAN is an indication that a lubricant is losing its effectiveness. A lubricant is generally considered to be past its usable service live when its TAN exceeds a value of 2.0 or even 1.0. The longer the period of operation time where a lubricant's TAN is below 2.0 or even 1.0, the longer the lubricant's service life and the better the lubricant's performance.

The results of testing completed is summarized in the table below:

TABLE 1

Summary of Hot Room Compressor Results

| Ex 1 TEST HRS | Ex 1 TAN Values[1] | Ex 2 TEST HRS | Ex 2 TAN Values[1] | Ex 3 TEST HRS[2] | Ex 3 TAN Values[1] | Ex 4 TEST HRS[2] | Ex 4 TAN Values[1] |
|---|---|---|---|---|---|---|---|
| 0 | 0.21 | 0 | 0.25 | 0 | 0.25 | 0 | 0.24 |
| 1 | 0.63 | 1 | 0.25 | 1 | 0.18 | 1 | 0.33 |
| 122 | 0.33 | 98 | 0.25 | 172 | 0.08 | 167 | 0.35 |
| 288 | 0.44 | 266 | 0.25 | 342 | 0.17 | 336 | 0.32 |
| 462 | 0.24 | 433 | 0.25 | 532 | 0.21 | 509 | 0.33 |
| 626 | 0.38 | 606 | 0.25 | 697 | 0.24 | 670 | 0.32 |
| 795 | 0.38 | 770 | 0.25 | 842 | 0.24 | 838 | 0.36 |
| 939 | 0.33 | 938 | 0.25 | 1011 | 0.23 | 1030 | 0.48 |
| 987 | 0.41 | 1106 | 0.25 | 1166 | 0.25 | 1179 | 0.49 |
| 1107 | 0.52 | 1275 | 0.25 | 1333 | 0.33 | 1341 | 0.45 |
| 1276 | 0.49 | 1442 | 0.25 | 1525 | 0.36 | 1509 | 0.41 |
| 1436 | 0.77 | 1610 | 0.25 | 1668 | 0.36 | 1678 | 0.45 |
| 1604 | 1.95 | 1725 | 0.25 | 1839 | 0.40 | 1870 | 0.41 |
| 1772 | 1.11 | 1895 | 0.25 | 2004 | 0.43 | 2013 | 0.40 |
| 1923 | 1.11 | 2064 | 0.28 | TEST INTERRUPTED | | 2183 | 0.44 |
| 2091 | 1.25 | 2233 | 1.65 | | | 2349 | 0.42 |
| 2229 | 1.31 | 2303 | 4.10 | | | 2521 | 0.42 |
| 2399 | 1.56 | 2378 | 19.60 | | | 2617 | 0.41 |
| 2566 | 2.23 | TEST STOPPED | | | | 2850 | 0.45 |
| 2739 | 3.24 | | | | | 3019 | 0.49 |
| 2811 | 4.00 | | | | | 3184 | 0.50 |
| TEST STOPPED | | | | | | 3376 | 0.50 |
| | | | | | | 3520 | 0.56 |
| | | | | | | 3687 | 0.55 |
| | | | | | | 3875 | 0.60 |
| | | | | | | 4027 | 0.65 |
| | | | | | | 4178 | 0.61 |
| | | | | | | 4345 | 0.67 |
| | | | | | | 4516 | 0.72 |
| | | | | | | 4680 | 0.74 |
| | | | | | | 4854 | 1.14 |
| | | | | | | 5020 | 1.23 |
| | | | | | | 5186 | 1.71 |
| | | | | | | 5219 | 1.67 |
| | | | | | | 5294 | 1.82 |
| | | | | | | 5386 | 2.63 |
| | | | | | | TEST STOPPED | |

[1]TAN values are measured per ASTM D974.

[2]The Example 3 test ended after the 2004 hour sample for reasons unrelated to the lubricant. Example 4 is essentially a repeat of Example 3 that shows how the results of Example 3 would have come out had that test been able to run to completetion.

The results show that the compositions of the present invention provide significantly improved lubricant performance as demonstrated by the extended useable service live (time of use before the TAN of the lubricant exceeds 1.0) of Examples 2 and 3 and 4 compared to Example 1. Example 1 shows that the use of antioxidants and metal passivators in a PAO-based lubricant does not perform well (the sample exceeds a TAN of 1.0 before 2233 hours of testing and exceed a TAN of 2.0 before 2303 hours of testing). Example 2 shows that a blend of PAO and a food grade polyol ester, with an additional additive package can perform better than Example 1. Furthermore Example 3 shows that a blend of PAO and food grade polyol ester in combination with a food grade additive package that combines antioxidants and metal passivators provides a significant improvement in performance compared to Example 1, and even compared to Example 2. Example 4, which is prepared using the same procedure and amounts of materials as Example 3, also shows this significant improvement, compared to Example 1, and even compared to Example 2 (the sample exceeds a TAN of 1,0 after 4854 hours of testing and exceed a TAN of 2.0 before 5386 hours of testing). The results also show that Examples 3 and 4 had very similar performance up until the test for Example 3 had to be discontinued. At about 2000 hours of run time, Examples 3 and 4 both had TAN values of about 0.4.

The performance of the lubricants may be evaluated by comparing the amount of test time that passes until the TAN of the lubricant exceeds 1.0. In some embodiments the lubricants may be evaluated by comparing, the amount of test time that passes until the TAN of the lubricant exceeds 2.0.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, all percent values, ppm values and parts values are on a weight basis. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

We claim:

1. A food grade lubricant composition consisting of:

(a) at least one polyalphaolefin base fluid;

(b) at least one food grade polyolester base fluid comprising the reaction product of at least one neopentyl polyhydric alcohol and at least one monocarboxylic acid;

(c) at least one food grade performance additive excluding lubricity additives; and (d) optionally at least one food grade oil consisting of at least one of the following: a synthetic ester, a white petroleum oil, and a severely hydro-treated petroleum oil.

2. The composition of claim 1 wherein the composition is more than 5 percent by weight polyolester base fluid.

3. The composition of claim 1 wherein component (c) comprises the combination of (i) one or more food grade antioxidants and (ii) one or more food grade metal passivators, wherein the metal passivator may comprise a metal deactivator, a corrosion inhibitor, or combinations thereof.

4. The composition of claim 1 wherein the composition has a kinematic viscosity from 30 to 320 cSt at 40° C.

5. The composition of claim 1 wherein:

component (a) is present from at least 1 percent by weight;

component (b) is present from at least 5 percent by weight; and component (c) is present from 0.01 to 6 percent by weight.

6. The composition of claim 1 wherein component (a) has a number average molecular weight of 425 to 2500.

7. The composition of claim 1 wherein component (a), the polyalphaolefin base fluid, comprises PAO2, PAO4, PAO6, PAO8, PAO10, PAO40, PAO100 or mixtures thereof.

8. The composition of claim 1 wherein component (b), the polyolester base fluid base fluid, comprises: esters of neopentyl glycol, trimethylol propane, pentaerythritol, dipentaerythritol, tripentaerythritol, carboxylic acids represented by the formula $HOC(O)R^1$, where $R^1$ is a saturated, cyclic, straight chain or branched hydrocarbon radical containing from 4 to 10 carbon atoms, or combinations thereof.

9. The composition of claim 1 wherein component (c) comprises at least one additional additive selected from the list consisting of antioxidants, metal deactivators, corrosion inhibitors, antifoams, antiwear inhibitors, corrosion inhibitors, pour point depressants, viscosity improvers, tackifiers, metal deactivators, extreme pressure additives, friction modifiers, foam inhibitors, emulsifiers, demulsifiers, or mixtures thereof.

10. The composition of claim 3 wherein component (c)(i), the antioxidant, comprises one or more aminic antioxidants, phenolic antioxidants, or combinations thereof; wherein component (c)(i) is present in the overall composition from 0.01 to 6 percent by weight.

11. The composition of claim 3 wherein component (c)(ii), the metal passivator, comprises one or more tolytriazole derived metal deactivators, fatty acids corrosion inhibitors derived from natural oils, or combinations thereof; wherein component (c)(ii) is present in the overall composition from 0.02 to 0.05 percent by weight.

12. A method for preparing a food-grade-lubricant composition consisting the steps of: a) providing at least one polyalphaolefin base fluid; b) providing at least one polyolester base fluid comprising the reaction product of at least one neopentyl polyhydric alcohol and at least one monocarboxylic acid; and c) providing at least one performance additive excluding lubricity additves; and, d) optionally at least one food grade oil consisting of at least one of the following: a synthetic ester, a white petroleum oil, and a severely hydro-treated petroleum oil; and e) blending the components to form the composition.

13. A method for lubricating a food industry mechanical device, the method comprising the steps of: lubricating the device with a composition consisting of:(a) at least one polyalphaolefin base fluid; (b) at least one polyolester base fluid comprising the reaction product of at least one neopentyl polyhydric alcohol and at least one monocarboxylic acid; and (c) at least one performance additive excluding ludricity additives; and (d) optionally at least one food grade oil consisting of at least one of the following: a synthetic ester, a white petroleum oil, and a severely hydro-treated petroleum oil; and e).

* * * * *